US005529266A

United States Patent [19]

Knight et al.

[11] Patent Number: 5,529,266

[45] Date of Patent: Jun. 25, 1996

[54] KITE

[76] Inventors: Carl E. Knight; Jo Ann F. Knight, both of 219-6th St., San Francisco, Calif. 94103

[21] Appl. No.: 367,900

[22] Filed: Jan. 3, 1995

[51] Int. Cl.[6] ..... B64C 31/06

[52] U.S. Cl. ..... 244/153 R

[58] Field of Search ..... 244/153 R, 153 A, 244/154, 155 R, 155 A; 446/34, 61, 66

[56] References Cited

U.S. PATENT DOCUMENTS 2,835,462 5/1958 Martin ..... 244/153 A 3,954,236 5/1976 Brown ..... 244/155 R 4,078,745 3/1978 Knight ..... 244/153 A 4,624,648 11/1986 Waters ..... 244/153 A

*Primary Examiner*—Galen L. Barefoot

*Attorney, Agent, or Firm*—Robert Charles Hill

[57] ABSTRACT

A rotary kite suitable for rotation in a direction perpendicular to the wind flow is provided with a symmetrical wind receiving surface supported by a frame and open at the ends thereof permitting the passage of air currents therethrough with at least two air vents and at least two internal vanes to cause rotation.

7 Claims, 4 Drawing Sheets

KITE

SUMMARY OF THE INVENTION

A rotary kite rotates in a direction perpendicular to the wind flow about an axis parallel to the wind flow. Air currents passing through the two open ends of the kite strike the vanes which are attached to the kite's wind receiving surface diagonal to the wind flow. Air vents are cut into the wind receiving surface alongside the vanes opposite to the wind flow allowing the flow of air to cause the kite to rotate.

BACKGROUND OF THE INVENTION

Kite flying continues to have widespread acceptance as an enjoyable form of recreation. Kite flyers range in age from the young to the elderly and kites continue to be produced in a myriad of sizes, shapes, and colors. Curiously enough kites that are increasingly complex in design and structure continue to be presented to the public. These complex kites delight the experienced kite flyer but offer little advantage to the very young or inexperienced in kite flying. Many of these kites have so much pull on the line it is impossible for a child to fly them.

Curiously enough one of the most suitable kites for children has not been developed to its full potential. This basic design when circular in shape is commonly called a Chinese lantern kite. A flying device of this basic design was recorded in The Bible over 2,500 years ago. Although this design has potential to be used as a rotating kite it is only recently that such attempts are recorded.

U.S. Pat No. 2,835,462 attempts to exploit the potential for using the Chinese lantern kite design as a rotating kite. The foremost requirement for using the Chinese lantern type kite as a rotating kite, however, is that its length must be approximately twice as long as its width. Deviation in either direction from these approximation dimensions results in lessened lifting ability. As this patent did not meet this requirement, a longitudinal shaft is employed which runs down the axis of the kite with front and rear stabilizers to bridle the kite.

Our own U.S. Pat. No. 4,078,745 eliminates the need for a central shaft and stabilizers for bridling by designing the kite twice as long as it is wide. Additionally to provide increased lift, a lifting lip is provided by recessing the bridle inside the kite. Large vanes were also designed on the trailing end of this kite to cause rotation and also increase stability.

Although the design of our own U.S. Pat. No. 4,078,745 can be used to make large kites that can be flown in strong winds it lacks the fuller potential for children that our present invention offers. Our present invention reduces the low wind flying range from approximately 8 miles per hour to approximately 4 miles per hours and makes it possible to make smaller kites. It also makes it possible to make larger kites and more stable kites in strong erratic winds.

One problem with prior art U.S. Pat. No. 4,078,745 is that in an enclosed kite if the longitudinal frame means are not strong enough and/or reinforced enough the kite will collapse inwardly due to atmospheric pressure. Resolving this problem of collapse in this prior art device results in a heavier kite due to the necessarily required heavier frame means. Also unwanted drag is increased with additional frame means.

A second problem with prior art U.S. Pat. No. 4,078,745 is the means for making the kite rotate. Large vanes are used outside the trailing edge of the kite. These vanes require a strengthened frame means; thus additional weight is added to the kite. Although these large outside vanes are desirable in strong winds they are a hindrance in lighter winds due to their own weight and the frame means required to support them.

A third problem with prior art U.S. Pat. No. 4,078,745 is the need for a recessed bridle. Although the recessed bridle makes a lifting lip which compensates for the added weight of a strengthened frame means, it makes this kite less desirable for children because the recessed bridle makes the kite less stable and gives greater pull on the kite string.

A fourth problem with prior art U.S. Pat. No. 4,078,745 is the inability of a heavy longitudinal frame means to adjust quickly to strong, gusty, changing winds.

The present invention eliminates or reduces all of the problems inherent in the above described device. The present invention reduces the problem due to atmospheric pressure by having air vents in the wind receiving surface. The problem relating to the heavy vanes on the trailing edge of the kite is resolved in the present invention by designing the vanes to serve as frame means. The problem relating to a need for a recessed bridle to compensate for added weight of a strengthened frame means is automatically resolved by the solutions to the aforementioned two problems namely reduced weight and reduced frame means. The problem relating to a heavy longitudinal frame means needed in strong, gusty, changing winds is resolved by the solutions to the first two problems namely reduced weight and reduced frame means. In our present invention the longitudinal frame means designed as vanes serves to rotate the kite instead of to impede its rotation. Thus in strong, gusty, changing winds our present invention is tethered to the line means at the axis of a heavy diagonal frame means which serves as an impeller to maintain rotation in changing winds. The heavy diagonal frame means tethered to the line means is more responsive in changing winds than a heavy diagonal frame means.

OBJECTS OF THE INVENTION

It is the primary object of the present invention to provide a new and improved rotary kite that will increase the wind range for flight.

A second object is to provide a new and improved rotary kite that will increase the range for the size of the kite either smaller or larger than present art forms.

DESCRIPTION OF THE PREFERRED EMBODIMENT

Figure 1:
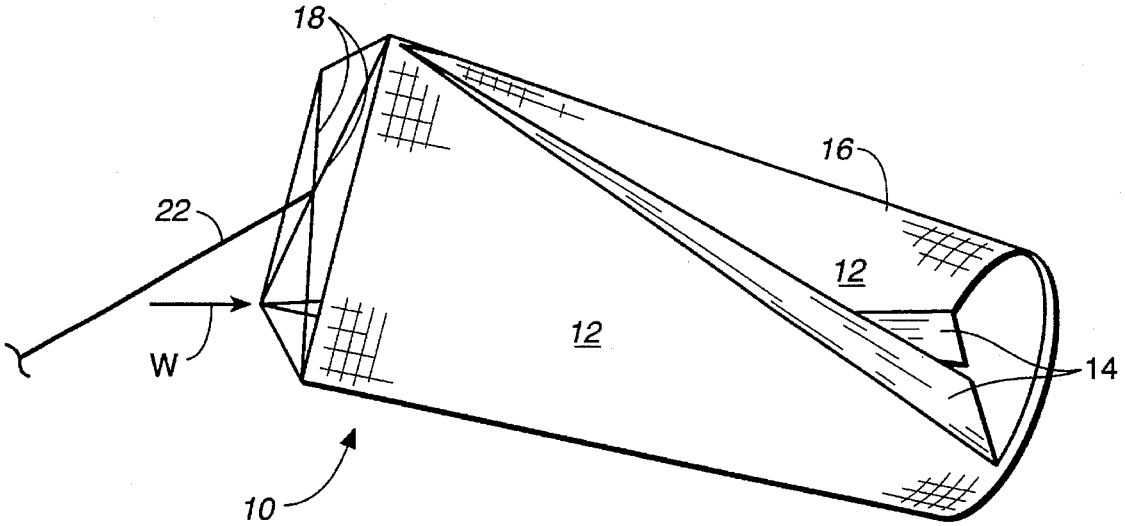
FIG. 1 is a perspective, elevational view of the rotary kite of the present invention in flying position.
Figure 2:
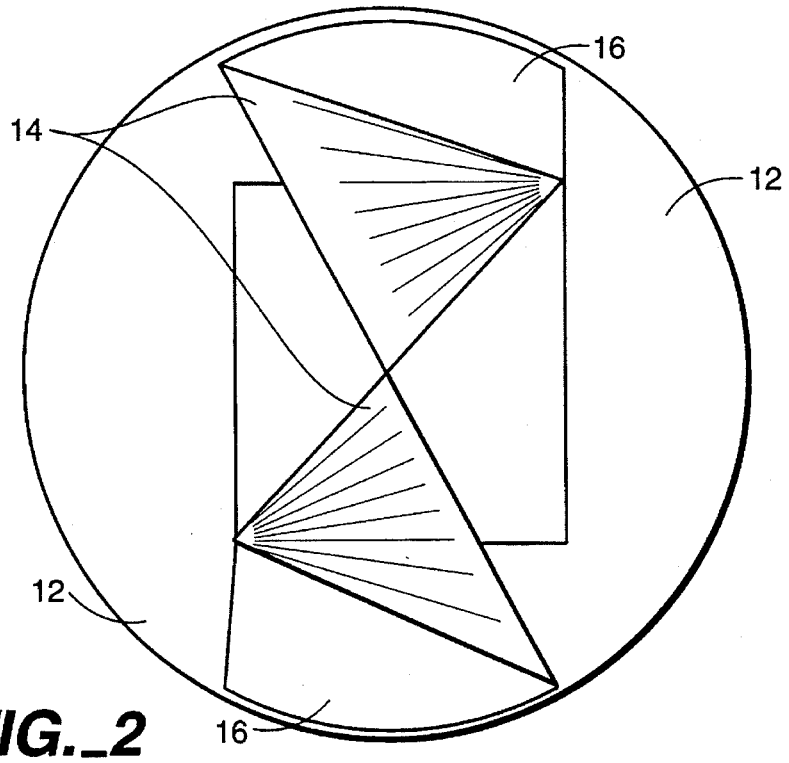
FIG. 2 is a perspective view looking through the kite from the trailing edge to the leading edge showing the wind receiving surface, the vanes and the air vents.
Figure 3:
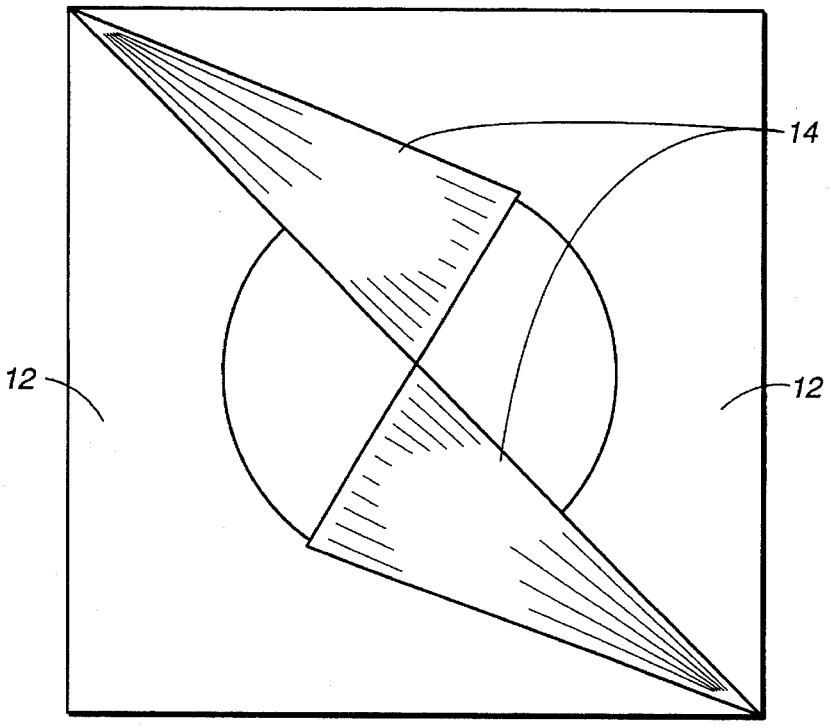
FIG. 3 is a perspective view looking through the kite from the leading edge to the trailing edge showing the wind receiving surface and the vanes.

Referring to FIGS. 1, 2, and 3 which illustrate the rotary kite of the present invention, the rotary kite generally indicated 10 has a wind receiving surface 12 symmetrical about a central axis and open at the ends thereof to permit the passage of air currents therethrough and supported by diagonal frame means 18 and vanes 14 and having air vents 16 cut out of the wind receiving surface 12 to allow the passage of air through the wind receiving surface 12 on one side of the vanes 14.

The wind receiving surface 12 can be of any well-known material such as paper, plastic, cloth, etc.

Figure 4:
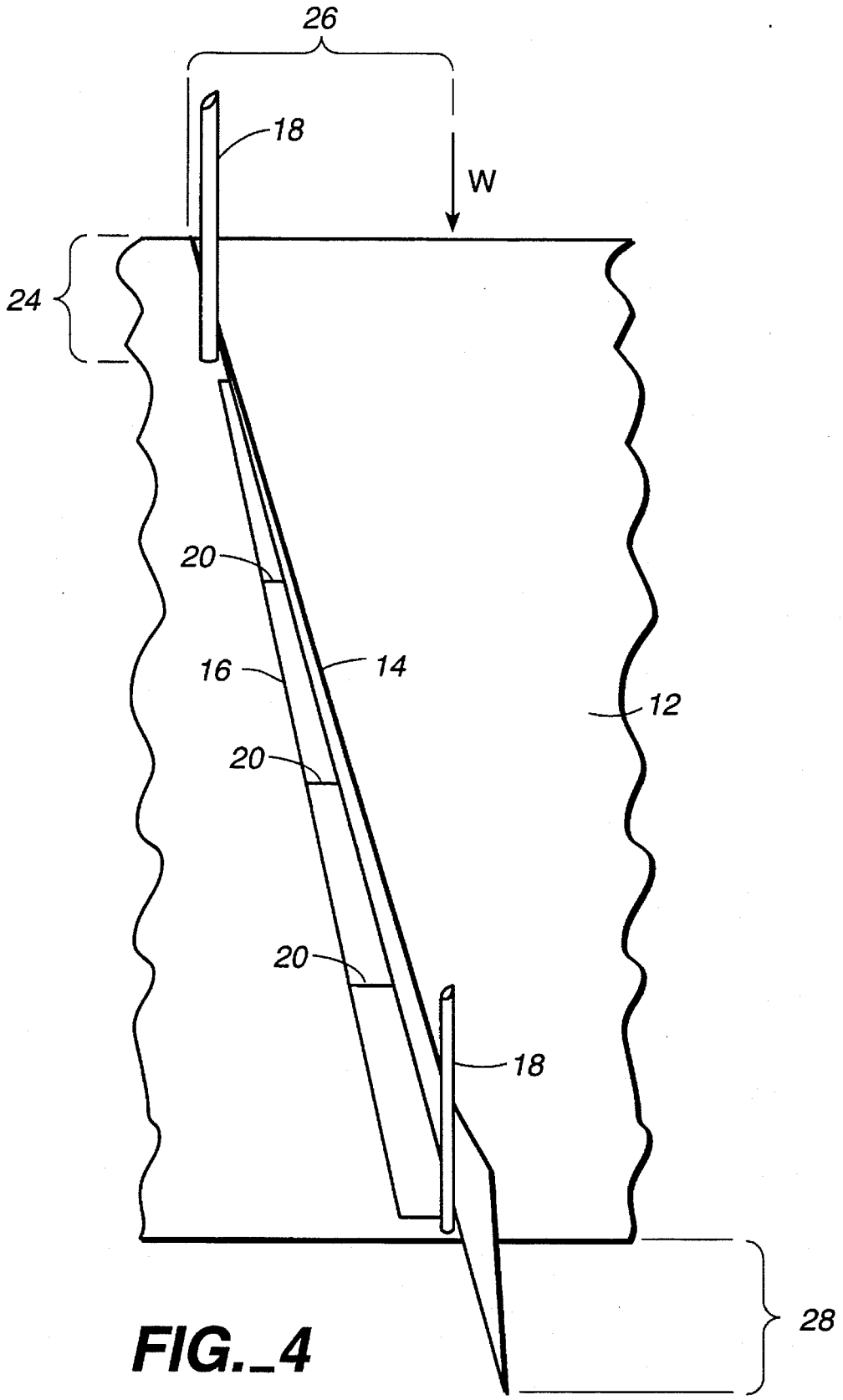
FIG. 4 is a sectional perspective view indicating vane offset and length specifications.

There are two or more diagonal frame means 18 as illustrated in FIGS. 1 and 4 which are attached where needed for frame means to the wind receiving surface 12 and/or to the vanes 14 by any suitable means. The diagonal frame means 18 can be rigid or flexible. The diagonal frame means 18 can be made of any suitable material such as thread, string, cord, wood, plastic, metal, etc. The kite 10 requires two or more diagonal frame means 18 attached to the wind receiving surface 12 at the leading edge of the wind receiving surface 12 as illustrated in FIG. 1 or recessed up to 15% of the length of the wind receiving surface 12 as illustrated by distance 24 in FIG. 4 Line means 22 is attached to the diagonal frame means 18 at the axis of the kite as illustrated in FIG. 1 for maintaining control of the kite during rotative flight. The arrow marked w indicates wind flow.

Figure 5:
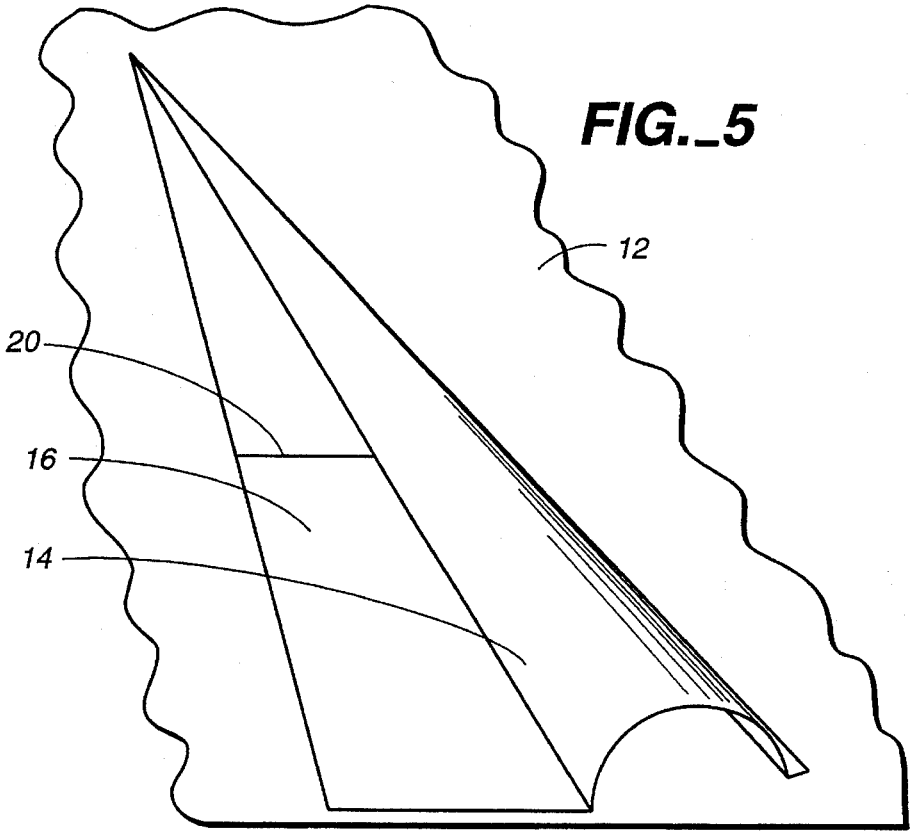
FIG. 5 is a sectional perspective view showing a method of vane attachment.
Figure 6:
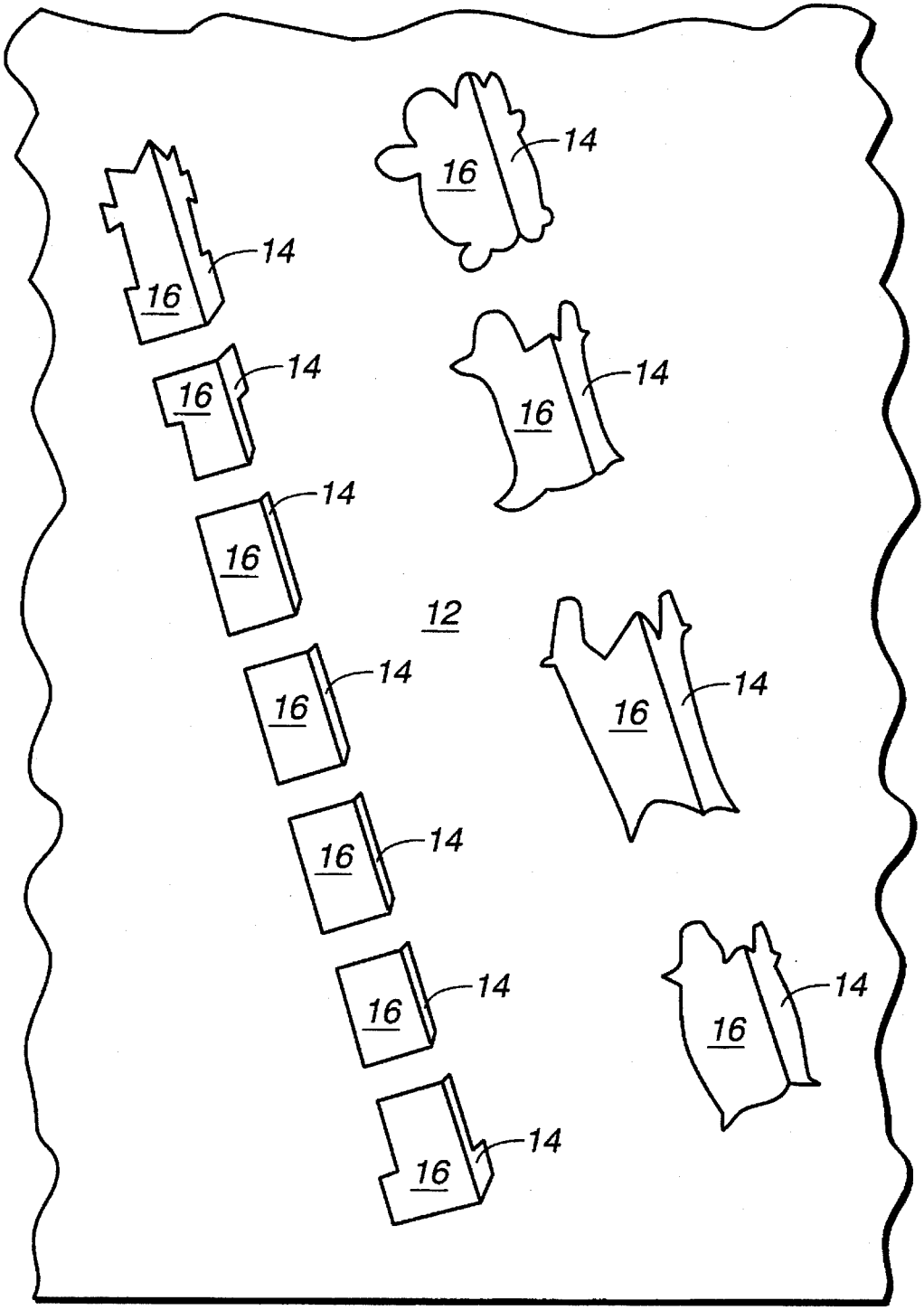
FIG. 6 is a sectional perspective view showing different vane and air vent shapes.

The vanes 14 as illustrated in FIGS. 1 through 6 serve as vanes to rotate the kite 10 and also serve to give frame means as a keel to the wind receiving surface 12. When extended beyond the trailing edge of the wind receiving surface 12 as illustrated in FIG. 4 the vanes ability to keep the kite aligned into the wind flow in strong and changing winds is improved. Together with a heavy, rigid diagonal frame means 18 at or near the leading edge of the wind receiving surface 12 the vanes 14 and the diagonal frame means 18 as illustrated in FIG. 4 can store and release energy to maintain a constant vortex of air through the kite to maintain lift and stability. There are two or more vanes 14 that are joined to the wind receiving surface 12 by any suitable means including gluing, taping, etc. as illustrated in FIGS. 1 through 6 at any angle above or below a mean of approximately 15° from wind flow that rotates the kite as illustrated by angle 26 in FIG. 4 where wind flow is indicated by the arrow marked w. The vanes 14 can also be attached in any additional way wherever needed such as in FIG. 3 where the vanes 14 are joined together at the axis of the kite 10; FIG. 4 where the vanes 14 are attached to the diagonal frame means 18; or FIG. 5 where the vanes 14 are attached in more than one place to the wind receiving surface 12. FIG. 5 illustrates the vane 14 joined to the wind receiving surface 12 at the apex of the vane 14 as well as alongside the air vent 16 to form a cup vane. The vanes 14 can be of any effective wind deflecting length from the leading edge of the wind receiving surface 12 to a distance of approximately 15% of the length of the wind receiving surface 12 beyond the trailing edge of the wind receiving surface 12 as illustrated by distance 28 in FIG. 4. The vanes 14 can be any effective wind deflecting width between the wind receiving surface 12 and the axis of the kite as illustrated in FIGS. 1 through 6. The vanes 14 can be any shape such as illustrated in FIG. 6 as long as the total area of the vanes 14 is aerodynamically balanced to give effective lift, rotation and stability to the kite 10. The total area of the vanes 14 can be any area above or below a mean area of 20% of the wind receiving surface 12 that will give sufficient lift, rotation, frame means, and stability to the kite 10.

The air vents 16 are cut into the wind receiving surface 12 alongside the vanes 14 opposite to wind flow as illustrated in FIGS. 1, 2, 4, 5 and 6. The surface cut from the wind receiving surface 12 to form the air vent 16 may be retained to the wind receiving surface 12 and folded toward the axis of the kite to form a vane as illustrated in FIG. 6. Each air vent 16 is the same size and shape or approximately the same size and shape as the vane 14 that it is alongside of as illustrated in FIGS. 1, 2, 4, 5 and 6. The air vents 16 serve to allow air flow through the wind receiving surface 12 alongside the vane 14 opposite to the wind flow as illustrated in FIG. 4 so that the movement of air against the vanes 14 rotates the kite 10. The air vents 16 also serve to reduce atmospheric pressure between the inside and the outside of the wind receiving surface 12. The wind receiving surface 12 is held together wherever needed across the air vents 16 by bands 20 as illustrated in FIGS. 4 and 5. The bands 20 can be made of any suitable material such as thread, string, cord, etc. and can be attached to the wind receiving surface 12 by any suitable means such as gluing, taping, sewing, etc.

It will be obvious that numerous modifications and variations are possible for the above described rotary kite within the scope of the present invention. The foregoing description, as setting forth various constructional and operational details for purposes of understanding only, is not to be taken as limiting the scope of the present invention which is defined only by the following claims.

We claim:

1. A rotary kite suitable for flight and rotation in a direction perpendicular to the wind flow comprising;

a symmetrical wind receiving surface having a leading edge and a trailing edge and open at the ends thereof to permit the passage of air currents therethrough;

diagonal frame means at the leading edge of the wind receiving surface;

line means connected to said frame means for maintaining control of the kite during rotative flight;

internal longitudinal vanes attached to said wind receiving surface;

and air vents in said wind receiving surface alongside said vanes to allow air to pass through said wind receiving surface thus allowing said kite to rotate.

2. The rotary kite of claim 1 wherein the length of the wind receiving surface is approximately twice the width of the open ends.

3. The rotary kite of claim 1 wherein the vanes serve as a frame means for the wind receiving surface.

4. The rotary kite of claim 1 wherein the vanes are attached to the diagonal frame means.

5. The rotary kite of claim 1 wherein the vanes are attached together.

6. The rotary kite of claim 1 wherein the vanes extend beyond the trailing edge.

7. The rotary kite of claim 6 wherein the vanes extend beyond the trailing edge a distance not to exceed 15% of the length of the wind receiving surface.

* * * * *